US006538609B2

(12) United States Patent
Nguyen et al.

(10) Patent No.: US 6,538,609 B2
(45) **Date of Patent: *Mar. 25, 2003**

(54) GLASS-MOUNTABLE ANTENNA SYSTEM WITH DC AND RF COUPLING

(75) Inventors: Anh Nguyen, Boynton Beach, FL (US); Argy A. Petros, Lake Worth, FL (US)

(73) Assignee: XM Satellite Radio Inc., Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/844,699

(22) Filed: Apr. 30, 2001

(65) Prior Publication Data

US 2002/0008667 A1 Jan. 24, 2002

Related U.S. Application Data

(63) Continuation-in-part of application No. 09/438,814, filed on Nov. 10, 1999, now Pat. No. 6,232,926.

(60) Provisional application No. 60/200,463, filed on Apr. 28, 2000, provisional application No. 60/241,361, filed on Oct. 19, 2000, and provisional application No. 60/241,362, filed on Oct. 19, 2000.

(51) Int. Cl.[7] ..... H01Q 1/32

(52) U.S. Cl. ..... 343/713; 343/704; 343/895

(58) Field of Search ..... 343/711, 712, 343/713, 704, 715, 795, 872, 895; 333/25, 32; 455/86, 90; H01Q 1/32

(56) References Cited

U.S. PATENT DOCUMENTS

| | | | | | |
|---|---|---|---|---|---|
| 4,089,817 | A | * | 5/1978 | Kirkendall | 343/713 |
| 4,109,214 | A | | 8/1978 | Main | 330/254 |
| 4,238,199 | A | | 12/1980 | Rothbühr et al. | 23/314 |
| 4,238,799 | A | | 12/1980 | Parfitt | 343/715 |
| 4,531,232 | A | | 7/1985 | Sakurai | 455/152 |
| 4,621,243 | A | * | 11/1986 | Harada | 333/24 R |
| 4,764,773 | A | | 8/1988 | Larsen et al. | 343/713 |
| 4,794,319 | A | | 12/1988 | Shimazaki | 343/715 |
| 4,825,217 | A | | 4/1989 | Choi | 343/715 |
| 4,916,456 | A | | 4/1990 | Shyu | 343/713 |
| 5,057,847 | A | | 10/1991 | Väisänen | 343/702 |
| 5,105,201 | A | | 4/1992 | Nakase et al. | 343/715 |
| 5,134,486 | A | | 7/1992 | Suzuki et al. | 358/190 |
| 5,161,255 | A | | 11/1992 | Tsuchiya | 455/345 |
| 5,212,492 | A | | 5/1993 | Jesman et al. | 343/713 |
| 5,278,572 | A | | 1/1994 | Harada et al. | 343/715 |
| 5,298,907 | A | | 3/1994 | Klein | 343/715 |
| 5,422,681 | A | | 6/1995 | Hayashi | 348/730 |
| 5,451,966 | A | | 9/1995 | Du et al. | 343/715 |
| 5,471,222 | A | * | 11/1995 | Du | 343/713 |
| 5,557,290 | A | | 9/1996 | Watanabe | 343/713 |
| 5,898,408 | A | * | 4/1999 | Du | 343/715 |
| 5,929,718 | A | | 7/1999 | Crosby | 333/24 R |
| 6,069,588 | A | | 5/2000 | O'Neill, Jr. | 343/713 |
| 6,097,345 | A | | 8/2000 | Walton | 343/769 |
| 6,166,698 | A | | 12/2000 | Turnbull et al. | 343/713 |
| 6,232,926 | B1 | * | 5/2002 | Nguyen et al. | 343/713 |

FOREIGN PATENT DOCUMENTS

| | | | |
|---|---|---|---|
| JP | 6260815 | 9/1994 | H01P/5/02 |

* cited by examiner

*Primary Examiner*—Tho Phan
(74) *Attorney, Agent, or Firm*—Roylance, Abrams, Berdo & Goodman, L.L.P.

(57) ABSTRACT

A vehicle antenna mounting system whereby the antenna, associated antenna electronics (e.g., LNA) and RF and DC coupling are provided in an integral antenna assembly for installation on the exterior of a vehicle. The integral antenna assembly comprises a base section enclosing the associated antenna electronics and RF and DC coupling devices, and an antenna section pivotably mounted on the base section comprising the antenna. Two or more antennas are provided in the integral antenna assembly for SDARS reception on at least one satellite channel and a terrestrial channel. Another satellite channel can be provided for diversity purposes, or a global positioning system (GPS) satellite receiver for performing location services, among others, for the vehicle.

19 Claims, 8 Drawing Sheets

GLASS-MOUNTABLE ANTENNA SYSTEM WITH DC AND RF COUPLING

CROSS REFERENCE TO RELATED APPLICATIONS

Related subject matter is disclosed in co-pending U.S. provisional patent application Serial No. 60/241,361, filed Oct. 19, 2000; and in co-pending U.S. provisional patent application Serial No. 60/241,362, filed Oct. 19, 2000; the entire content of each of these applications being expressly incorporated herein by reference.

The application is a continuation-in-part of U.S. application Ser. No. 09/438,814, filed Nov. 10, 1999 now U.S. Pat. No. 6,232,926.

This application claims benefit under 35 U.S.C. § 119(e) of a U.S. provisional application of Anh Nguyen et al entitled"Multiple-Coupling Vehicle SDARS Glass Mount Antenna System", Ser. No. 60/200,463, filed Apr. 28, 2000, the entire content of which is incorporated herein by reference.

FIELD OF THE INVENTION

The invention relates generally to transmission of radio frequency signals (e.g., SDARS signals) from an antenna across a dielectric such as glass to a receiver disposed in a vehicle, as well as the transmission across glass of power from the receiver to antenna electronics. The invention also relates to an integral antenna assembly for mounting externally on the dielectric surface that comprises one or more antennas, antenna electronics, as well as components for radio frequency and direct current coupling through the dielectric with internally mounted receiver components.

BACKGROUND OF THE INVENTION

With reference to FIG. 1, a number of antenna systems have been proposed which provide for the transfer of radio frequency (RF) energy through glass or other dielectric surface to avoid having to drill holes, for example, through the windshield or window of an automobile for installation. Glass-mount antenna systems are advantageous because they obviate the necessity of having to provide a proper seal around an installation hole or other window opening in order to protect the interior of the vehicle and its occupants from exposure to external weather conditions.

In the conventional antenna system 20 depicted in FIG. 1, RF signals from an antenna 22 are conducted across a glass surface 24 via a coupling device 26 that typically employs capacitive coupling, slot coupling or aperture coupling. The portion of the coupling device 26 on the interior of the vehicle is connected to a matching circuit 28 which provides the RF signals to a low noise amplifier (LNA) 32 at the input of a receiver 34 via an RF or coaxial cable 30. The antenna system 20 is disadvantageous because the matching circuit 28, losses associated with the cable 30 and RF coupling (e.g., on the order of 2 to 4 dB or more) cause an increase in system noise.

Another proposed antenna system 40, which is described with reference to FIG. 2, has an RF coupling device similar to that used in the antenna system 20 depicted in FIG. 1, as well as DC coupling components to provide power to the antenna electronic circuitry. The antenna system 40 is configured to transmit video signals from satellite antenna electronics through a glass window 46 into a structure such as a residence or office building without requiring a hole through the glass. An exterior module 42 is mounted, for example, on the exterior of the structure, while an interior module 44 and receiver 48 are provided within the structure. RF coupling units 50*a* and 50*b* are provided on opposite sides of the glass 46 which is typically a window in the building. RF coupling unit 50*b* is connected to the exterior module 42 via a coaxial cable 54 to allow the exterior module 42 to be located remotely (e.g., on the building rooftop) therefrom. The exterior module 42 encloses an antenna 52 and associated electronics (e.g., an LNA 56) to receive RF signals, which are then provided from the LNA 56 to the coupling device 50*b* via the cable 54 for transfer through the glass 46.

With continued reference to FIG. 2, RF energy transferred through the glass 46 is processed via a matching circuit 58. The matching circuit 58 is connected to a receiver 48 by another coaxial cable 60. In addition, DC power is provided from the interior module 44 to the exterior module 42 (e.g., to provide power for the LNA 48) by low frequency DC coupling coils 62*a* and 62*b* mounted opposite each other on either side of the glass 46. In a conventional satellite TV system, electrical power for the satellite antenna electronics is provided from the receiver 48 on the same coaxial cable that provides video signals from the antenna 52 to the receiver 48.

While the provision of DC power to antenna electronics is useful, the matching circuit and cable losses associated with the antenna system 40 are not desirable for such applications as an in Satellite Digital Audio Radio Services (SDARS) system antenna for a vehicle. At 800 MHz, the coupling loss experienced with conventional glass mount antenna arrangements can be as much as 3 dB. At higher frequencies, the coupling loss increases substantially. For such high frequency applications as satellite radio operating at 2.4 GHz, the coupling loss is expected to be unacceptably high (e.g., 2 to 4 dB), making reception difficult. A need therefore exists for a glass-mounted antenna arrangement for high frequency wireless communication applications, and particularly, satellite radio applications, that reduces coupling loss.

Further, installation of a cable (e.g., such as the coaxial cable 54 in FIG. 3) on the exterior of a vehicle window or windshield is undesirable in terms of installation, as is drilling through glass. The installation of an antenna assembly 42 located remotely with respect to the external coupling devices indicated at 45 is generally considered unattractive to consumers of mobile satellite services. A need therefore exists for a vehicle antenna mounting system whereby the antenna, associated antenna electronics (e.g., LNA) and RF and DC coupling are provided in an integral assembly for installation on the exterior of a vehicle.

SUMMARY OF THE INVENTION

The above described disadvantages are overcome and a number of advantages are realized by a vehicle antenna mounting system whereby the antenna, associated antenna electronics (e.g., LNA) and RF and DC coupling are provided in an integral antenna assembly for installation on the exterior of a vehicle.

In accordance with an aspect of the present invention, the integral antenna assembly comprises a base section enclosing the associated antenna electronics and RF and DC coupling devices, and an antenna section pivotably mounted on the base section comprising the antenna.

In accordance with another aspect of the present invention, the vehicle antenna mounting system comprises two or more antennas in the integral antenna assembly for SDARS reception on at least one satellite channel and a terrestrial channel. In addition another satellite channel can be provided for diversity purposes, or a global positioning system (GPS) satellite receiver for performing location services, among others, for the vehicle.

In accordance with still yet another aspect of the present invention, the antenna section comprises a quadrifilar antenna for reception of one or more satellite channels, and a linear antenna disposed within the quadrifilar antenna for reception of terrestrial signals.

BRIEF DESCRIPTION OF THE DRAWINGS

Throughout the drawing figures, like reference numerals will be understood to refer to like parts and components.

DETAILED DESCRIPTION OF THE PREFERRED EMBODIMENTS

Figure 1:
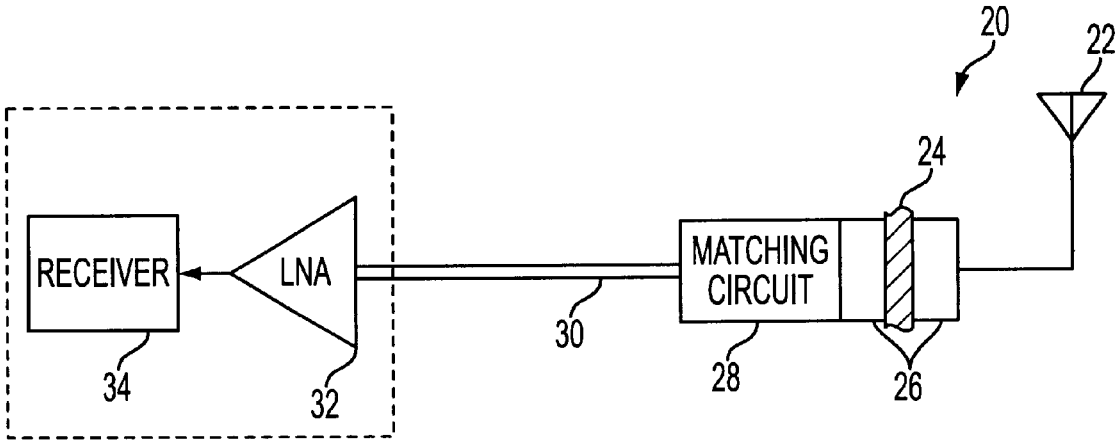
FIG. 1 (PRIOR ART)
FIG. 1 depicts a conventional antenna system that allows inductive transfer of RF energy across a dielectric such as glass.
Figure 3:
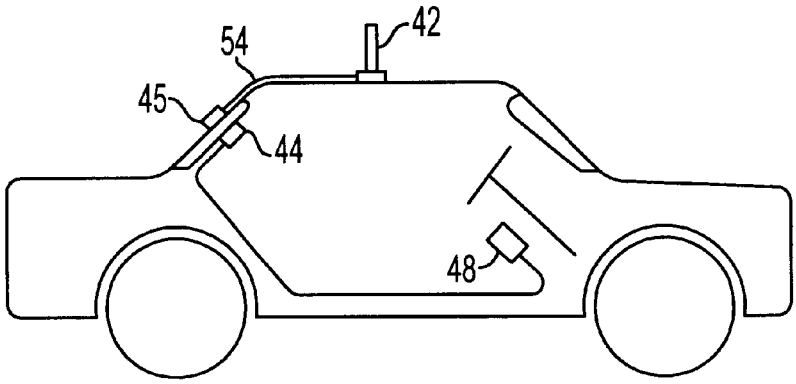
FIG. 3 (PRIOR ART)
FIG. 3 depicts a vehicle with the conventional antenna system of FIG. 2 mounted thereon.
Figure 2:
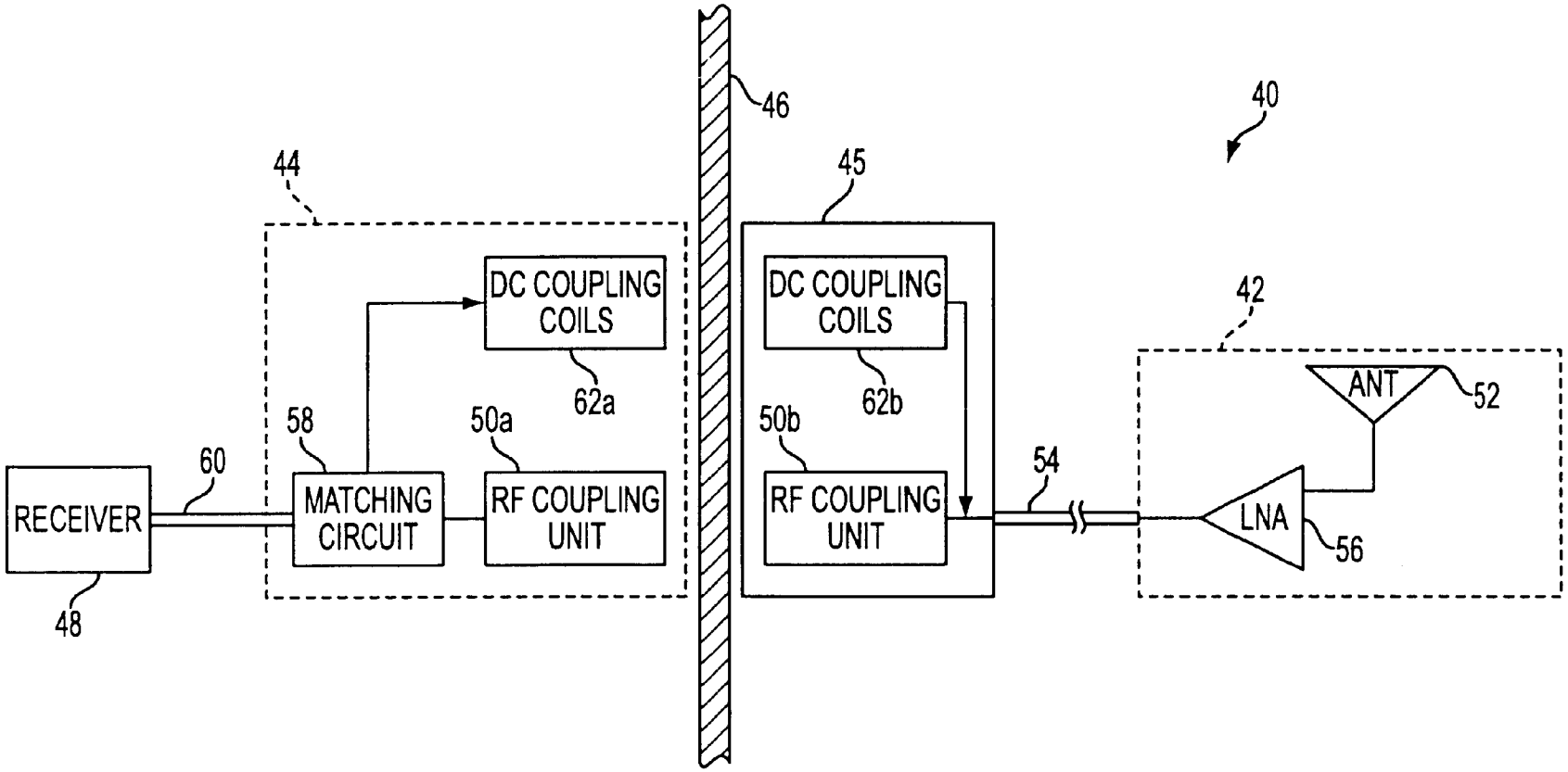
FIG. 2 (PRIOR ART)
FIG. 2 depicts a conventional antenna system for installation on a building for satellite reception of video signals.
Figure 4:
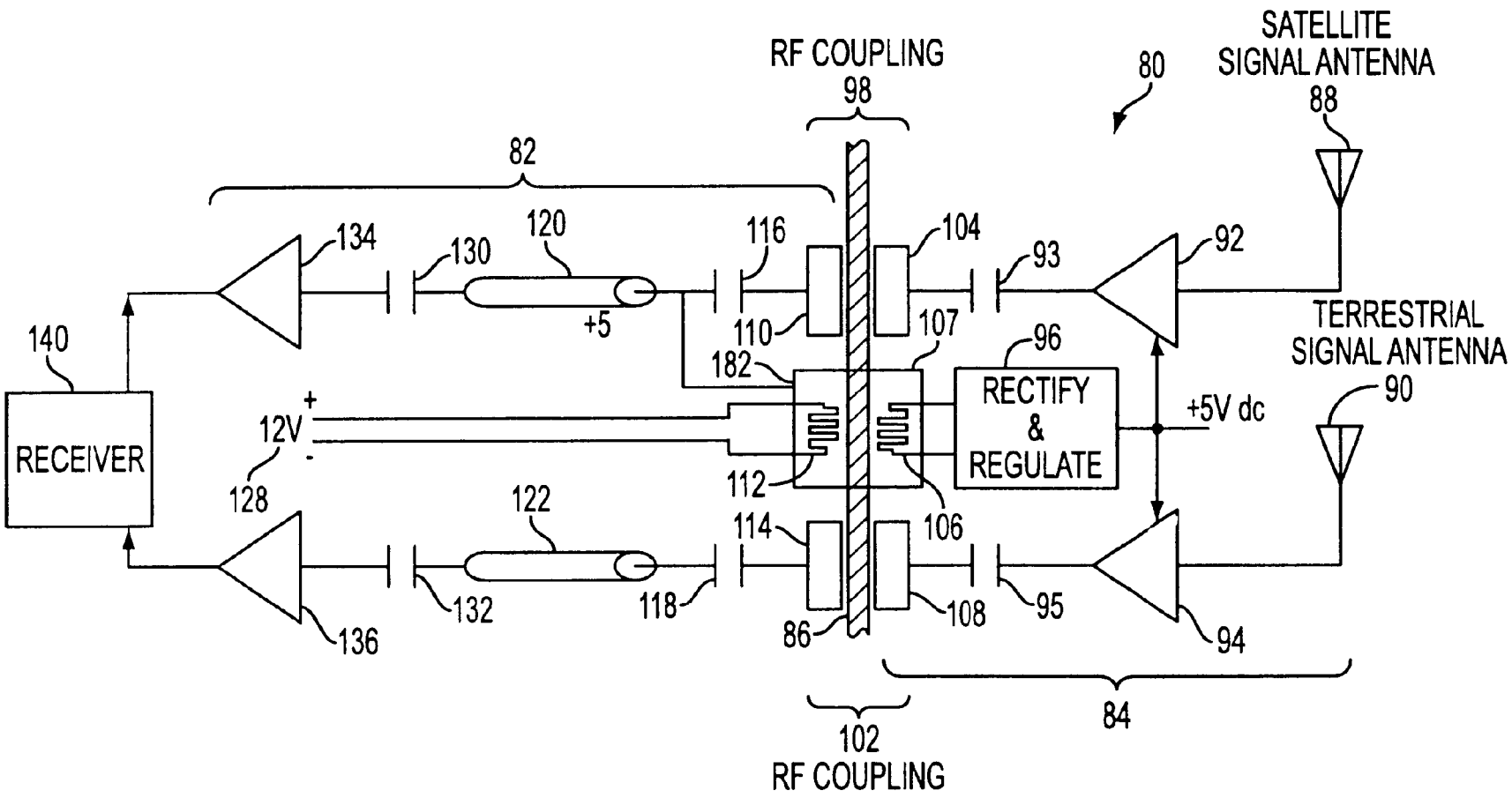
FIG. 4 is a schematic diagram of an antenna system constructed in accordance with an embodiment of the present invention.

With reference to FIG. 4, an antenna system 80 constructed in accordance with the present invention is shown which is configured for satellite reception (e.g., SDARS) at a vehicle. The antenna system comprises an interior module 82 for installation inside the vehicle (e.g., in the passenger or engine compartment of an automobile), and an exterior module 84 for installation on the exterior of a vehicle (e.g., on the front or rear windshield or a window of the vehicle). The interior module 82 and the exterior module 84 are preferably mounted on opposite sides of a dielectric such as glass 86 (e.g., an automobile windshield or window). In accordance with the present invention, the antenna system 80 employs plural antennas, RF and DC coupling, as well as an integral antenna assembly for mounting on the exterior surface of the glass 86.

In the illustrated example, two antennas 88 and 90 are used for signal reception, that is, a satellite signal antenna and a terrestrial signal antenna, respectively. As described below, the antenna system 222 depicted in FIG. 9, employs a Global Positioning System (GPS) antenna, as well as SDARS satellite and SDARS terrestrial signal antennas. In addition, a second satellite signal antenna and associated circuitry can be provided to the antenna systems 80 and 222 for time and/or spatial diversity purposes. A discussion now follows of the advantages of using a satellite signal antenna and a terrestrial signal antenna, and/or plural satellite signal antennas.

Radio frequency transmissions are often subjected to multipath fading. Signal blockages at receivers can occur due to physical obstructions between a transmitter and the receiver or service outages. For example, mobile receivers encounter physical obstructions when they pass through tunnels or travel near buildings or trees that impede line of sight (LOS) signal reception. Service outages can occur, on the other hand, when noise or cancellations of multipath signal reflections are sufficiently high with respect to the desired signal.

Communication systems can incorporate two or more transmission channels for transmitting the same program or data to mitigate the undesirable effects of fading or multipath. For example, a time diversity communication system delays the transmission of program material on one transmission channel by a selected time interval with respect to the transmission of the same program material on a second transmission channel. The duration of the time interval is determined by the duration of the service outage to be avoided. The non-delayed channel is delayed at the receiver so that the two channels can be combined, or the program material in the two channels selected, via receiver circuitry. One such time diversity system is a digital broadcast system PBS) employing two satellite transmission channels.

A communication system that employs diversity combining uses a plurality of transmission channels to transmit the same source data or program material. For example, two or more satellites can be used to provide a corresponding number of transmission channels. A receiver on a fixed or mobile platform receives two or more signals transmitted via these different channels and selects the strongest of the signals or combines the signals. The signals can be transmitted at the same radio frequency using modulation resistant to multipath interference, or at different radio frequencies with or without modulation resistant to multipath. In either case, attenuation due to physical obstructions is minimized because the obstructions are seldom in the LOS of both satellites.

Accordingly, a satellite broadcast system can comprise at least one geostationary satellite for line of sight (LOS) satellite signal reception at receivers. Another geostationary satellite at a different orbital position can be provided for diversity purposes. One or more terrestrial repeaters can be provided to repeat satellite signals from one of the satellites in geographic areas where LOS reception is obscured by tall buildings, hills and other obstructions. It is to be understood that different numbers of satellites can be used, and satellites in other types of orbits can be used. Alternatively, a broadcast signals can be sent using only a terrestrial transmission system. The satellite broadcast segment preferably includes the encoding of a broadcast channel into a time division multiplexed (TDM) bit stream. The TDM bit stream is modulated prior to transmission via a satellite uplink antenna The terrestrial repeater segment comprises a satellite downlink antenna and a receiver/demodulator to obtain a baseband TDM bitstream. The digital baseband signal is applied to a terrestrial waveform modulator, and is then frequency translated to a carrier frequency and amplified prior to transmission. Regardless of which satellite and terrestrial repeater arrangement is used, receivers are provided with corresponding antennas to receive signals transmitted from the satellites and/or terrestrial repeaters.

As stated previously, the exemplary antenna system 80 illustrated in FIG. 4 comprises a satellite signal antenna 88 and a terrestrial signal antenna 90. Signals received via the antennas 88 and 90 are amplified as indicated at 92 and 94, respectively. The amplified signals are then provided, respectively, to RF coupling devices 80 and 102 via capacitors 93 and 95. The exterior module 84 preferably comprises patch antennas 104 and 108 for RF coupling that are mounted on the exterior of the glass 86 opposite patch antennas 110 and 114, respectively, provided in the interior module 82. The patch antenna pairs allow for transmission of RF energy corresponding to the amplified signals through the glass 86. It is to be understood that other RF coupling devices can be used such as capacitive plates or apertures or slot antennas. Thus, the exterior module 84 allows RF signals received via antennas mounted on the exterior of a vehicle to be provided to a receiver 140 inside the vehicle without the need for a hole in the windshield or window of the vehicle.

With continued reference to FIG. 4, the RF coupled signals from the antennas 88 and 90 are provided to respective coaxial cables 120 and 122 connected to the patch antennas 110 and 114 via corresponding capacitors 116 and 118. The cables 120 and 122 provide the received signals from the satellite and the terrestrial repeater, respectively, to amplifiers 134 and 136 via capacitors 130 and 132. The amplified signals at the corresponding outputs of the amplifiers 134 and 136 are provided to a receiver 140 for diversity combining and playback via loudspeakers in the vehicle, for example.

Figure 6:
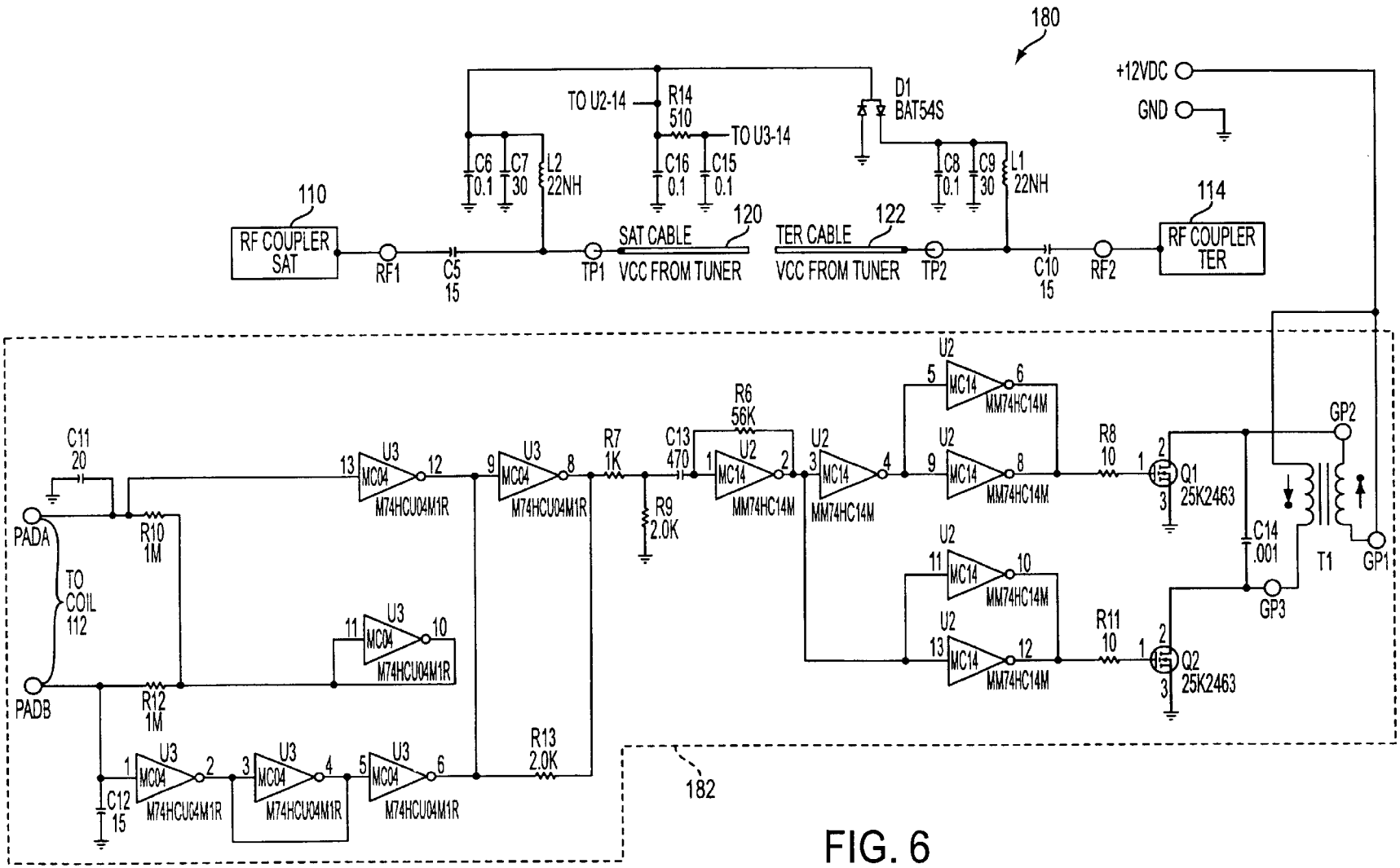
FIG. 6 is a schematic diagram of an interior coupling circuit for an antenna system constructed in accordance with an embodiment of the present invention.

The present invention is advantageous in that the interior module 82 provides power to circuit components (e.g., the amplifiers 92 and 94) in the exterior module 84. The supply of power is preferably via DC coupling to also avoid the need for a hole in the windshield or window of the vehicle. DC power from a power source (e.g., a 12 volt DC battery provided in the vehicle) is converted to an AC power signal using the circuit 182 described below in connection with FIG. 6. The magnetic coil 112 is located in an interior DC coupling housing 113 that is mounted on the interior of the glass 86 opposite an exterior DC coupling housing 107 enclosing a magnetic coil 106. The ratio of turns for the coils 112 and 106 are selected to transmit an AC power signal of selected voltage across the glass 86. The coil 106 is connected to a rectification and regulation circuit 96 that converts the AC signal transmitted across the glass 86 into a DC signal for supply to the amplifiers 92 and 94.

Figure 5:
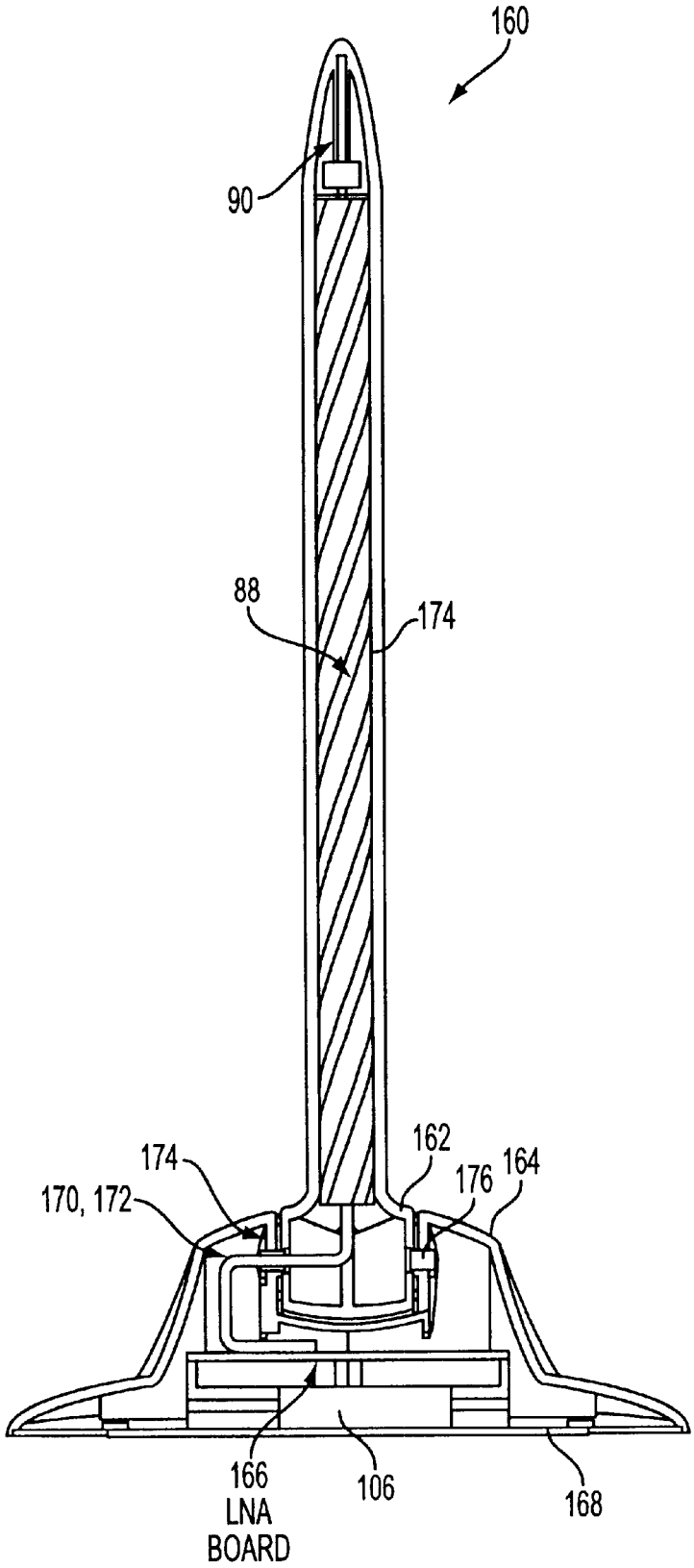
FIG. 5 is an elevational, cross-sectional view of an integral, glass-mounted antenna assembly constructed in accordance with an embodiment of the present invention.

In accordance with an embodiment of the present invention, the exterior module 84 is an integral external antenna assembly 160, as depicted in FIG. 5. The antenna assembly 160 comprises a base housing 164, and an antenna housing 162 that is pivotably connected to the base housing 164 via bushings 174 and 176. A least one of the bushings 174 is preferably hollow and dimensioned to accommodate cables 170 and 172 connecting the satellite signal antenna 88 and the terrestrial signal dipole antenna 90, respectively, to a corresponding low noise amplifier (LNA) on an LNA circuit board 166. The bushings 174 and 176 preferably also function as pins about which the antenna housing 162 rotates.

With continued reference to FIG. 5, the base housing 164 is connected to the glass 86 in a conventional manner for glass-mounted antennas (e.g., using adhesive). The base housing 164 further comprises an exterior DC/RF coupling circuit board 168 comprising external RF coupling devices (e.g., patch antennas 104 and 108), as well as an exterior DC coupling device (e.g., the coil 106). The antenna housing 162 preferably comprises a quadrifilar antenna 88 for satellite signal reception and a linear dipole antenna 90 for terrestrial signal reception. The cable 170 is connected to the quadrifilar antenna which comprises strips that are disposed along a helical path on a cylindrical structure 174 within the antenna housing 162. The cable 172 is connected to a linear antenna that is disposed along the interior, longitudinal axis of the cylindrical structure 174 so as to be exposed above the cylindrical structure. The quadrifilar antenna 88 allows for the reception of signals from another satellite source. The external antenna assembly 160 can also be modified to include another antenna such as a GPS antenna if desired. The exterior antenna assembly 160 is advantageous because it encompasses plural antennas, RF and DC coupling and is a integrated design that does not have separate cables connecting it to a remote RF or DC coupling device.

The exterior DC/RF coupling circuit board 168 and the LNA board 166 are described below in connection with FIGS. 7 and 8, respectively. An interior DC/RF coupling circuit 180 will first be described with reference to FIG. 6. The interior DC/RF coupling circuit 180 is preferably disposed within the interior module 82. The RF signals received via the antennas 88 and 90 are transmitted across the glass 86 via the RF coupling devices (e.g., patch antennas) 110 and 114 and provided to a receiver 140 via the cables 120 and 122, respectively. The interior DC/RF coupling circuit 180 also provides DC power to the exterior module 84 (e.g., the external antenna assembly 160). The interior DC/RF coupling circuit 180 comprises an oscillator and transformer circuit 182 for converting a DC power input into an AC signal that can be transferred across the glass 86 to the exterior module 84. The transformer T1 and transistors Q1 and Q2 create an AC signal, along with a number of logic gates, that oscillates at a selected frequency. The terminals PADA and PADB allow for feedback (e.g., to determine if the frequency at each of the terminals is substantially the same). The coils 112 and 106 preferably have different turn ratios such that the AC signal applied to the exterior module 84 is less voltage than the AC signal generated in the interior module 82. The oscillator and transformer circuit 182 preferably does not operate until the interior antenna assembly 82 is connected to the receiver 140. Once connected, the receiver supplies 5 volts to the oscillator and transformer circuit 182 via the cable 120 which enables the oscillator and transformer circuit 182 to commence generation of an AC signal. This arrangement is advantageous because it prevents unnecessary drain from the 12 volt source.

Figure 7:
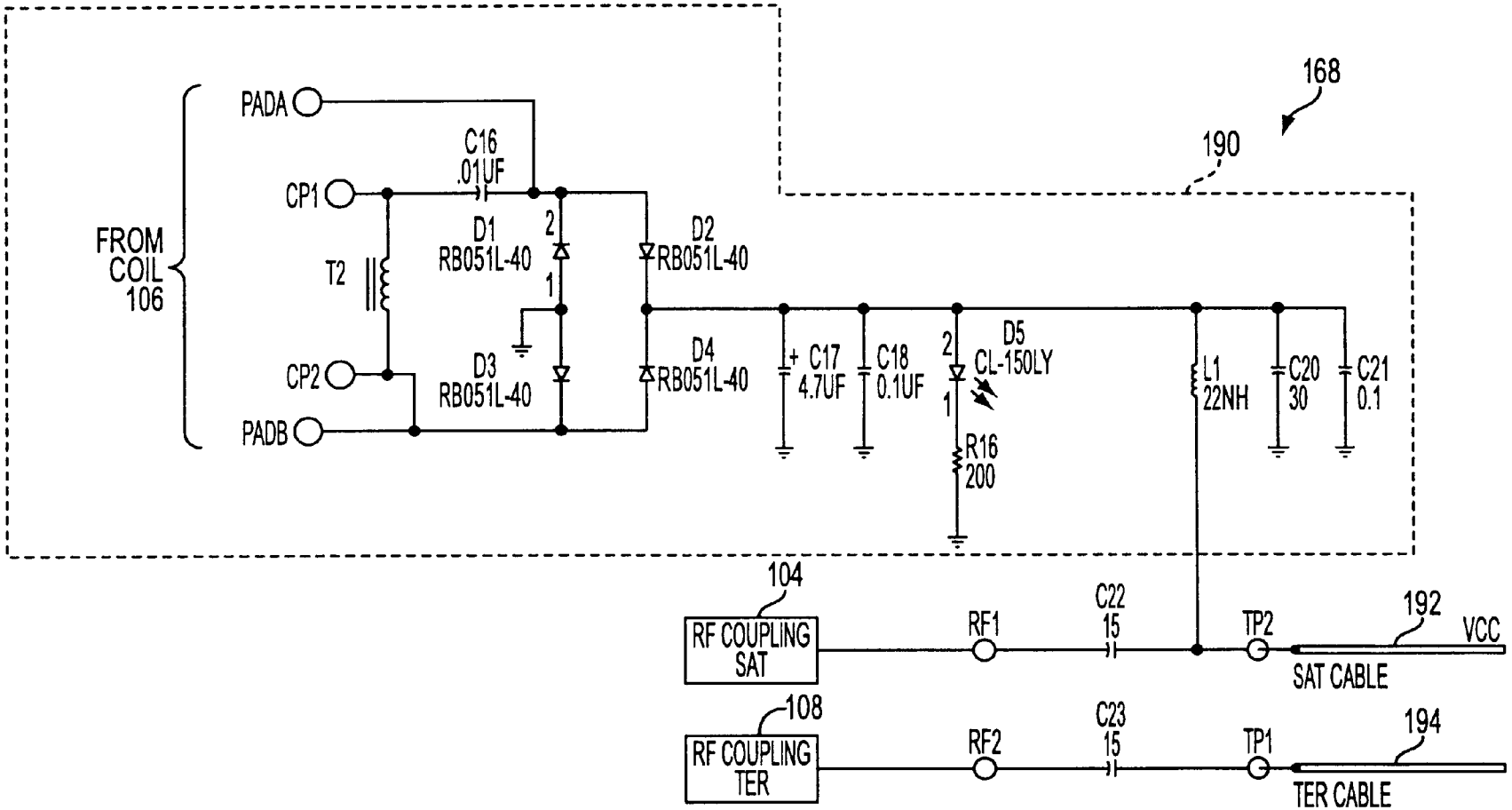
FIG. 7 is schematic diagram of an exterior coupling circuit for an antenna system constructed in accordance with an embodiment of the present invention.

With reference to FIG. 7, the AC signal is rectified via a rectification and regulation circuit 190 which converts the AC signal transferred across the glass 86 from the interior module 82 into a DC power signal. Cables 190 and 192 transport the RF signals received via the antennas 88 and 90 and conditioned via the LNA board 166 to the RF coupling devices 104 and 108, respectively (e.g., patch antennas). Although not shown in FIG. 5, cables 192 and 194 connect the boards 166 and 168. The DC signal need only be applied to the LNA board 166 via one of the cables such as the cable 192 in the illustrated embodiment.

Figure 8:
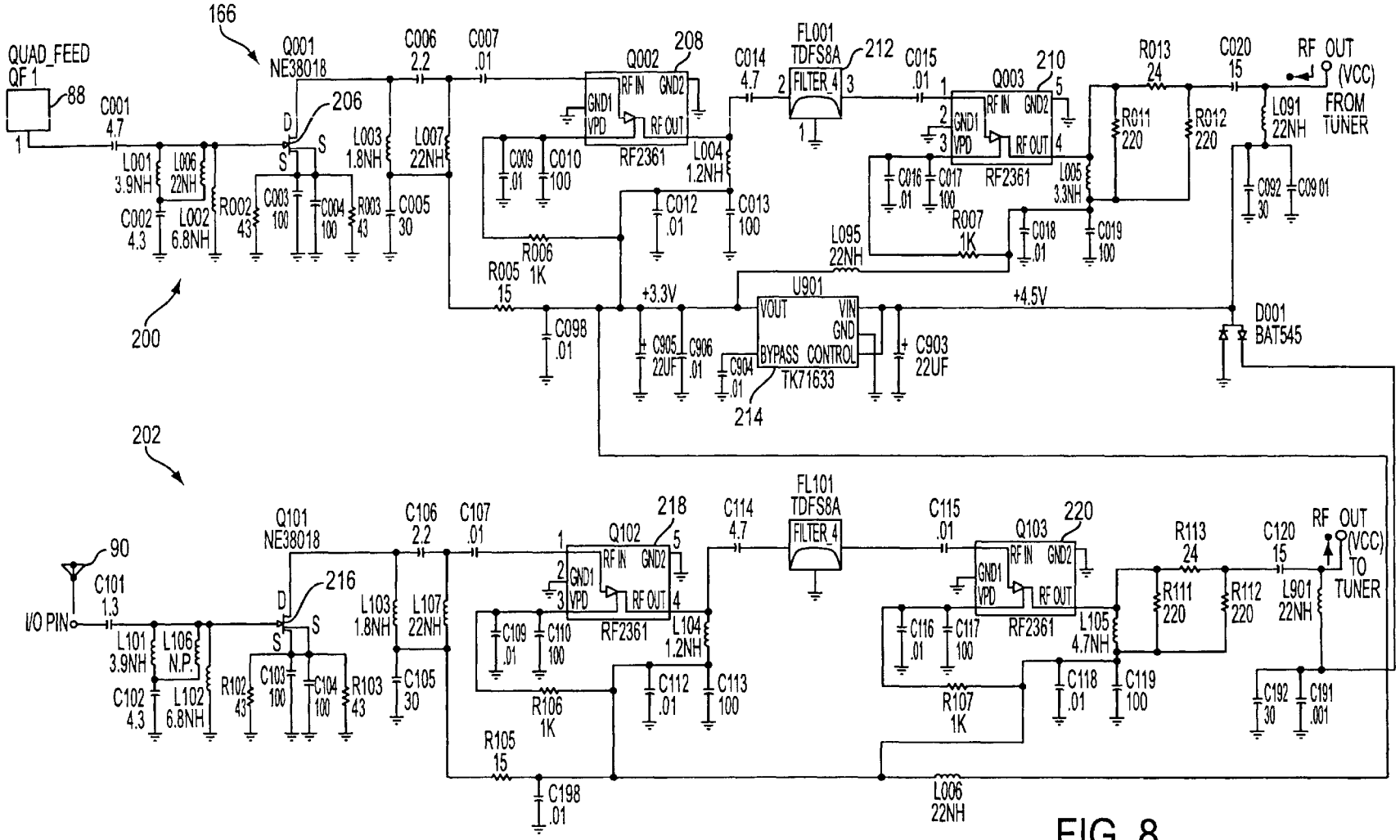
FIG. 8 is schematic diagram of a low noise amplifier circuit for an antenna system constructed in accordance with an embodiment of the present invention.

The LNA board 166 depicted in FIG. 8 preferably comprises three amplifier stages for each signal path, that is, for the satellite signal reception path 200 commencing with the satellite signal antenna 88 and for the terrestrial signal reception path 202 commencing with the terrestrial signal antenna 90. The gain can be as much as 34 dB. With regard to the signal path 200, the amplifier stages are indicated at 206, 208 and 210. A filter 212 is provided to reduce out-of-band interference and improve image rejection. In addition, a DC regulator 214 regulates the DC power signal received via the cable 192 (e.g., from 5 volts to 3.3 volts) to power the LNA board components. Similarly, the signal path 202 comprises amplifier stages indicated at 216, 218 and 220, as well as a filter 212 to reduce out-of-band interference.

Figure 9:
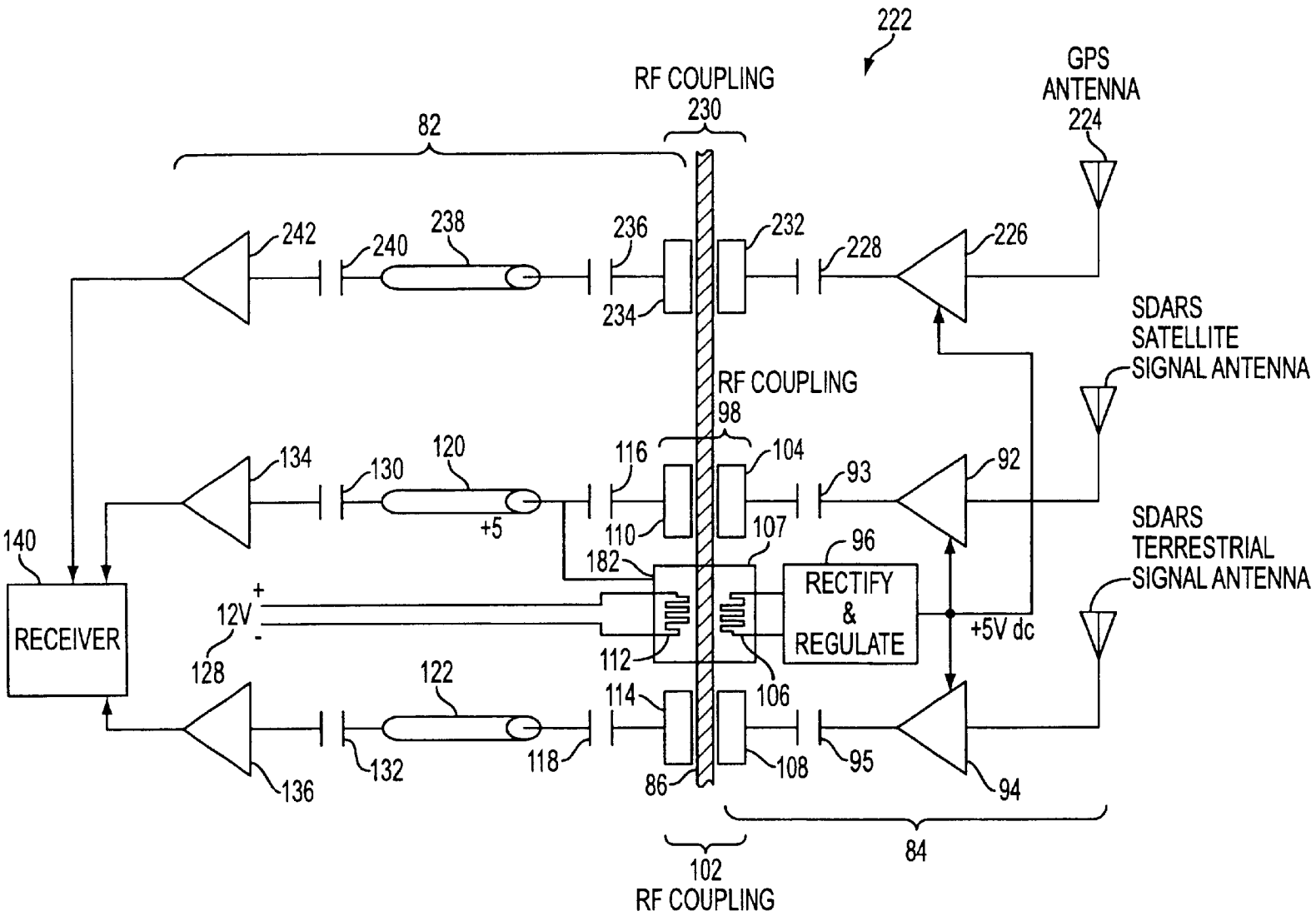
FIG. 9 is a schematic diagram of an antenna system constructed in accordance with an embodiment of the present invention.

The antenna assembly 222 depicted in FIG. 9 is similar to the antenna assembly 80 depicted in FIG. 4, except that the antenna assembly 222 further comprises another receiver arm for receiving GPS signals. A GPS antenna 224 provides received signals to an amplifier 226. The amplified signal is then provided to an RF coupling device 230 that comprises, for example, patch antennas 232 and 234 mounted on opposite sides of the glass 86. A coaxial able 238 in the interior module 82 provides the RF signal transferred through the glass 86 to an amplifier 242 which, in turn, provides the received signal to the receiver 140. The amplifier 226 can receive power from the interior module via the same DC coupling described above in connection with the other two satellite reception arms.

Although the present invention has been described with reference to a preferred embodiment thereof, it will be understood that the invention is not limited to the details thereof. Various modifications and substitutions will occur to those of ordinary skill in the art. All such substitutions are intended to be embraced within the scope of the invention as defined in the appended claims.

What is claimed is:

1. An antenna system comprising:

an interior antenna assembly having a first radio frequency coupling device connected to a dielectric surface and a first direct current coupling device connected to said dielectric surface; and an exterior antenna assembly comprising a first antenna for receiving a radio frequency signal from a satellite, an amplifier for amplifying said radio frequency signal, a second radio frequency coupling device mounted opposite said first radio frequency coupling device on the other side of said dielectric surface for transferring said radio frequency signal thereto through said dielectric surface, and a second direct current coupling device mounted opposite said first direct current coupling device on the other side of said dielectric surface for receiving a power signal therefrom through said dielectric surface;

said exterior antenna assembly further comprising a second antenna for receiving a terrestrially transmitted signal, a terrestrial signal amplifier for amplifying said terrestrially transmitted signal, a third radio frequency coupling device and a third direct current coupling device, said interior antenna assembly having a fourth radio frequency coupling device and a fourth direct current coupling device mounted opposite said third radio frequency coupling device and said third direct current coupling device, respectively, for radio frequency coupling of said terrestrially transmitted signal and direct current coupling of said power signal for supplying power to said terrestrial signal amplifier;

wherein said first antenna, said second antenna, said amplifier, said terrestrial signal amplifier, said second radio frequency coupling device, said second direct current coupling device, said third radio frequency coupling device and said third direct current coupling device are arranged in an integral housing.

2. An antenna system as claimed in claim 1, wherein said integral housing comprises a base section and an antenna section pivotably mounted on said base section, said base section enclosing said amplifier, said terrestrial signal amplifier, said second radio frequency coupling device, said second direct current coupling device, said third radio frequency coupling device and said third direct current coupling device, said antenna section enclosing said first antenna and said second antenna.

3. An antenna system as claimed in claim 2, wherein said antenna section is a unitary, tubular member that encloses both of said first antenna and said second antenna and is electrically connected to said base section.

4. An exterior antenna assembly for mounting on a dielectric surface opposite an interior antenna assembly, the internal antenna assembly having a first radio frequency coupling device and a first direct current coupling device connected to the dielectric surface, the exterior antenna system comprising:

a first antenna for receiving a radio frequency signal;

a second antenna for receiving a terrestrially transmitted signal;

an amplifier for amplifying said radio frequency signal;

a terrestrial signal amplifier for amplifying said terrestrially transmitted signal;

a second radio frequency coupling device mounted opposite said first radio frequency coupling device on the other side of said dielectric surface for transferring said radio frequency signal thereto through said dielectric surface;

a second direct current coupling device mounted opposite said first direct current coupling device on the other side of said dielectric surface for receiving a power signal therefrom through said dielectric surface;

a third radio frequency coupling device and a third direct current coupling device, said interior antenna assembly having a fourth radio frequency coupling device and a fourth direct current coupling device mounted opposite said third radio frequency coupling device and said third direct current coupling device, respectively, for radio frequency coupling of said terrestrially transmitted signal and direct current coupling of said power signal for supplying power to said terrestrial signal amplifier; and a housing enclosing said first antenna, said second antenna, said amplifier, said terrestrial signal amplifier, said second radio frequency coupling device, said second direct current coupling device, said third radio frequency coupling device and said third direct current coupling device.

5. An exterior antenna assembly as claimed in claim 4, wherein said housing comprises a base section and an antenna section pivotably mounted on said base section, said base section enclosing said amplifier, said terrestrial signal amplifier, said second radio frequency coupling device, said second direct current coupling device, said third radio frequency coupling device and said third direct current coupling device, said antenna section enclosing said first antenna and said second antenna.

6. An exterior antenna assembly as claimed in claim 5, wherein said antenna section is a unitary, tubular member that encloses both of said first antenna and said second antenna and is electrically connected to said base section.

7. An antenna system comprising:

an interior antenna assembly having a first radio frequency coupling device connected to a dielectric surface and a first direct current coupling device connected to said dielectric surface; and an exterior antenna assembly comprising at least one antenna for receiving a radio frequency signal, an amplifier for amplifying said radio frequency signal, a second radio frequency coupling device mounted opposite said first radio frequency coupling device on the other side of said dielectric surface for transferring said radio frequency signal thereto through said dielectric surface, and a second direct current coupling device mounted opposite said first direct current coupling device on the other side of said dielectric surface for receiving a power signal therefrom through said dielectric surface, said antenna, said amplifier, said second radio frequency coupling device and said second direct current coupling device being arranged in an integral housing;

wherein said integral housing comprises a base section and an antenna section pivotably mounted on said base section, said base section enclosing said amplifier, said second radio frequency coupling device and said second direct current coupling device, said antenna section enclosing said antenna; and wherein said antenna is a satellite signal antenna operable to receive a satellite signal, further comprising a terrestrial signal antenna operable to receive a terrestrially transmitted signal, said antenna section comprising said satellite signal antenna and said terrestrial signal antenna.

8. An antenna system as claimed in claim 7, wherein said base section further comprises a terrestrial signal amplifier for amplifying said terrestrially transmitted signal, a third radio frequency coupling device and a third direct current coupling device, said interior antenna assembly having a fourth radio frequency coupling device and a fourth direct current coupling device mounted opposite said third radio frequency coupling device and said third direct current coupling device, respectively, for radio frequency coupling of said terrestrially transmitted signal and direct current coupling of said power signal for supplying power to said terrestrial signal amplifier.

9. An antenna system as claimed in claim 7, wherein said antenna is a quadrifilar antenna and said terrestrial signal antenna is a dipole antenna.

10. An antenna system as claimed in claim 9, wherein said quadrifilar antenna is disposed in said antenna section of said integral housing, and said dipole antenna is disposed along said quadrifilar antenna.

11. An antenna system as claimed in claim 9, further comprising a second satellite antenna in said antenna section for receiving a second satellite signal, said base section further comprising a second satellite signal amplifier for amplifying said second satellite signal, a fifth radio frequency coupling device and a fifth direct current coupling device, said interior antenna assembly having a sixth radio frequency coupling device and a sixth direct current coupling device mounted opposite said fifth radio frequency coupling device and said fifth direct current coupling device, respectively, for radio frequency coupling of said second satellite signal and direct current coupling of said power signal for supplying power to said second satellite signal amplifier.

12. An antenna system as claimed in claim 11, wherein said quadrifilar antenna is used to receive both of said satellite signal and said second satellite signal.

13. An antenna system comprising:

an interior antenna assembly having a first radio frequency coupling device connected to a dielectric surface and a first direct current coupling device connected to said dielectric surface; and an exterior antenna assembly comprising at least one antenna for receiving a radio frequency signal, an amplifier for amplifying said radio frequency signal, a second radio frequency coupling device mounted opposite said first radio frequency coupling device on the other side of said dielectric surface for transferring said radio frequency signal thereto through said dielectric surface, and a second direct current coupling device mounted opposite said first direct current coupling device on the other side of said dielectric surface for receiving a power signal therefrom through said dielectric surface, said antenna, said amplifier, said second radio frequency coupling device and said second direct current coupling device being arranged in an integral housing; and wherein said interior antenna assembly is configured to connect to a receiver that supplies power thereto, said interior antenna assembly comprising an alternating current signal generation circuit for generating an alternating current signal from a direct current source for transfer to said exterior antenna assembly via said first direct current coupling device and said second direct current coupling device, said alternating current signal generation circuit not operating to generate said alternating current signal until said interior antenna assembly is connected to said receiver and receiving power therefrom.

14. An exterior antenna assembly for mounting on a dielectric surface opposite an interior antenna assembly, the internal antenna assembly having a first radio frequency coupling device and a first direct current coupling device connected to the dielectric surface, the exterior antenna assembly comprising:

at least one antenna for receiving a radio frequency signal;

an amplifier for amplifying said radio frequency signal;

a second radio frequency coupling device mounted opposite said first radio frequency coupling device on the other side of said dielectric surface for transferring said radio frequency signal thereto through said dielectric surface;

a second direct current coupling device mounted opposite said first direct current coupling device on the other side of said dielectric surface for receiving a power signal therefrom through said dielectric surface; and an housing enclosing said antenna, said amplifier, said second radio frequency coupling device and said second direct current coupling device;

wherein said housing comprises a base section and an antenna section pivotably mounted on said base section, said base section enclosing said amplifier, said second radio frequency coupling device and said second direct current coupling device, said antenna section enclosing said antenna;

wherein said antenna is a satellite signal antenna operable to receive a satellite signal, further comprising a terrestrial signal antenna operable to receive a terrestrially transmitted signal, said antenna section comprising said satellite signal antenna and said terrestrial signal antenna.

15. An exterior antenna assembly as claimed in claim 14, wherein said base section further comprises a terrestrial signal amplifier for amplifying said terrestrially transmitted signal, a third radio frequency coupling device and a third direct current coupling device, said interior antenna assembly having a fourth radio frequency coupling device and a fourth direct current coupling device mounted opposite said third radio frequency coupling device and said third direct current coupling device, respectively, for radio frequency coupling of said terrestrially transmitted signal and direct current coupling of said power signal for supplying power to said terrestrial signal amplifier.

16. An exterior antenna assembly as claimed in claim 15, further comprising a second satellite antenna in said antenna section for receiving a second satellite signal, said base section further comprising a second satellite signal amplifier for amplifying said second satellite signal, a fifth radio frequency coupling device and a fifth direct current coupling device, said interior antenna assembly having a sixth radio frequency coupling device and a sixth direct current coupling device mounted opposite said fifth radio frequency coupling device and said fifth direct current coupling device, respectively, for radio frequency coupling of said second satellite signal and direct current coupling of said power signal for supplying power to said second satellite signal amplifier.

17. An exterior antenna assembly as claimed in claim 16, wherein said antenna is a quadrifilar antenna that is used to receive both of said satellite signal and said second satellite signal.

18. An exterior antenna assembly as claimed in claim 14, wherein said antenna is a quadrifilar antenna and said terrestrial signal antenna is a dipole antenna.

19. An exterior antenna assembly as claimed in claim 18, wherein said quadrifilar antenna is disposed in said antenna section of said housing, and said dipole antenna is disposed along said quadrifilar antenna.

* * * * *